United States Patent [19]

Urdshals

[11] Patent Number: 5,025,742

[45] Date of Patent: Jun. 25, 1991

[54] TURRET MOORING FOR AN OIL TANKER

[75] Inventor: Karl A. B. Urdshals, Southpoint, Singapore

[73] Assignee: Nortrans Shipping and Trading Far East PTE Ltd., Singapore, Singapore

[21] Appl. No.: 456,655

[22] Filed: Dec. 29, 1989

[51] Int. Cl.[5] ..... B63B 21/00

[52] U.S. Cl. ..... 114/230; 141/357

[58] Field of Search ..... 114/265, 230, 264; 441/3-5; 166/355, 352, 353, 354, 356; 175/5-7; 141/357

[56] References Cited

U.S. PATENT DOCUMENTS 4,606,727 8/1986 Koenig et al. ..... 114/230 X 4,765,378 8/1988 Engelskirchen et al. ..... 114/230 X 4,841,895 6/1989 Brewerton ..... 114/230

*Primary Examiner*—Ed Swinehart

*Attorney, Agent, or Firm*—Jones, Tullar & Cooper

[57] ABSTRACT

A turret type mooring for a seagoing vessel, such as an oil tanker, is disclosed. The mooring includes a fluid swivel joint which is formed in the bow of the vessel for loading and unloading oil or other fluid to or from the vessel. The mooring is disposed within a watertight compartment and can be accessed for repairs, maintenance and monitoring purposes from within the vessel so that external access beneath the waterline is not required and the mooring can be serviced without taking it or the vessel out of operation.

2 Claims, 3 Drawing Sheets

TURRET MOORING FOR AN OIL TANKER

BACKGROUND OF THE INVENTION

1. Field of the Invention

The present invention relates in general to a turret type mooring system for a seagoing vessel, such as an oil tanker.

2. Description of the Prior Art

The use of a turret type mooring for mooring all types of vessels, especially oil tankers, is now becoming more widespread. These types of moorings are typically employed to allow oil to be pumped to and from an oil tanker off-shore, and include a fluid swivel joint which allows an oil pipe on the tanker to rotate relative to a supply or discharge pipe so that excess strain will not be imposed upon the joint by motion of the tanker relative to the mooring. In prior art moorings of this type, a turret support structure is attached externally to the bow of the vessel. As a result, all of the mechanisms of the turret mooring including the fluid swivel joints, flexible piping connections, bearings, etc. are external to the vessel and below the waterline thus making maintenance, repairs and monitoring of the turret mooring and associated equipment difficult or impossible while the mooring is in use.

SUMMARY OF THE INVENTION

It is therefore the object of the present invention to provide a turret type mooring for all types of vessels which permits maintenance, repairs and monitoring of the turret mooring and associated equipment to be easily carried out while a vessel is moored and in any loading condition.

This and other objects of the invention are achieved through use of a turret mooring which is attached to a vessel so that direct access may be had to the mooring mechanisms from inside the vesel. In a preferred embodiment of the invention, one or more fluid swivel joints, flexible piping connections and main turret bearings are housed within a small compartment in the bow structure of the vessel which can be accessed from within the vessel through a watertight door. As a result, maintenance, repair and monitoring of these parts of the turret mooring can be easily accomplished.

BRIEF DESCRIPTION OF THE DRAWINGS

The foregoing and other objects, features and advantages of the present invention will become apparent from the following detailed description thereof taking in conjunction with the accompanying drawings in which.

DETAILED DESCRIPTION OF THE PREFERRED EMBODIMENT

Figure 1:
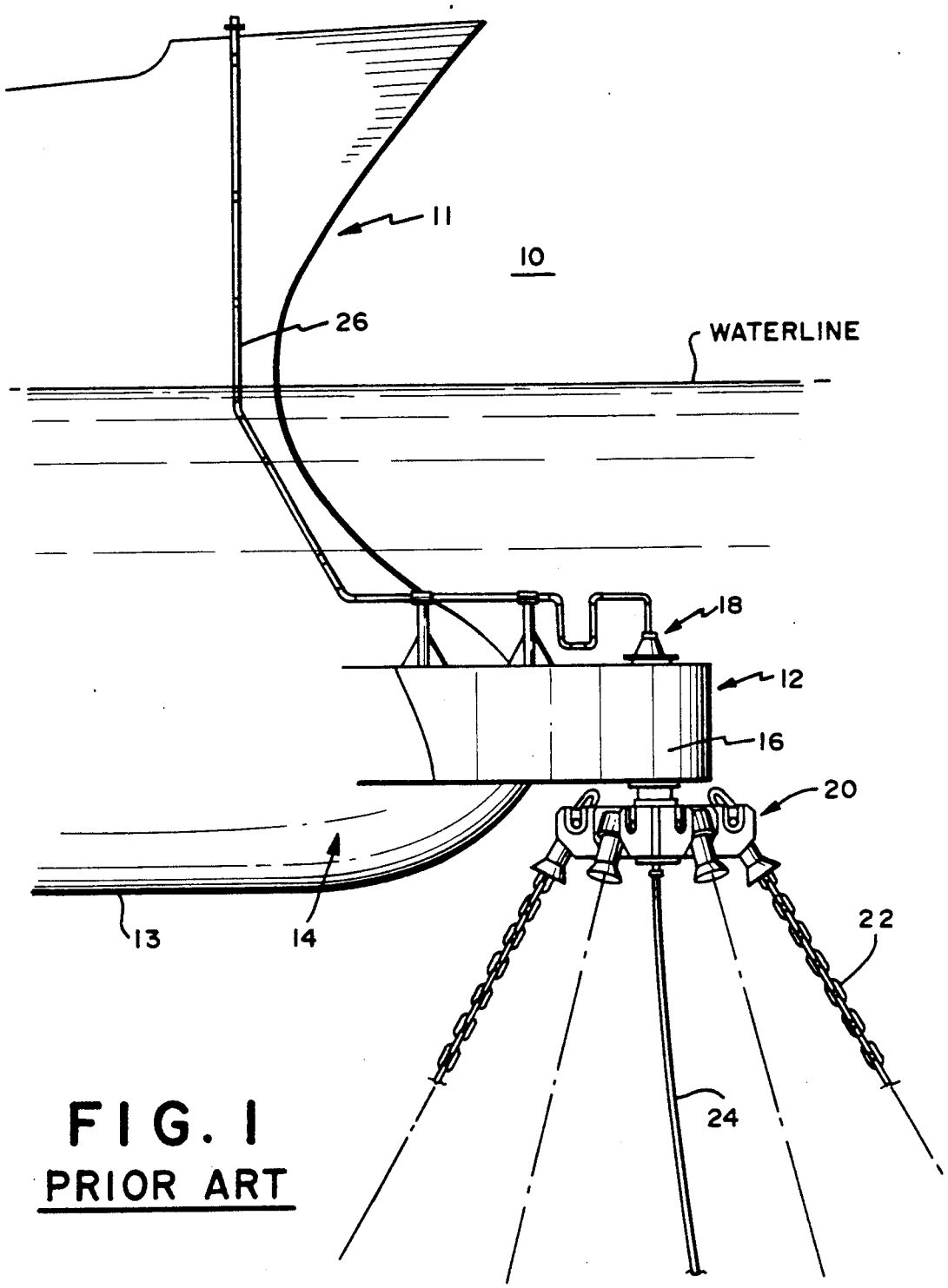
FIG. 1 PRIOR ART
FIG. 1 is a side elevation of a vessel with a prior art vessel turret mooring.

Turning now to a more detailed consideration of the invention, there is illustrated in FIG. 1, a prior art vessel mooring system 10 for a vessel 11 which includes a turret mooring 12. The mooring 12 is mounted externally of a hull 13 of the vessel 11 adjacent a bow 14 by means of a turret support structure 16. The turret mooring 12 includes a fluid swivel joint 18 and a spider 20 to which are attached a plurality of anchor pendants 22 and a flexible hose or pipe 24 for connection to a fluid source or receiver (not shown). The fluid swivel joint 18 rotatably connects the flexible hose or pipe 24 to a length of flexible piping 26 that is attached externally to the vessel structure and leads to oil receiving compartments therein (not shown). Access to the piping 26, swivel joint 18 and associated mechanisms and bearings must be achieved below the waterline external to the vessel 11 for maintenance, repair or monitoring. This is undesireable because it requires either that a diver be employed or that the vessel be put in dry dock to service or monitor the turret mooring 12.

Figure 2:
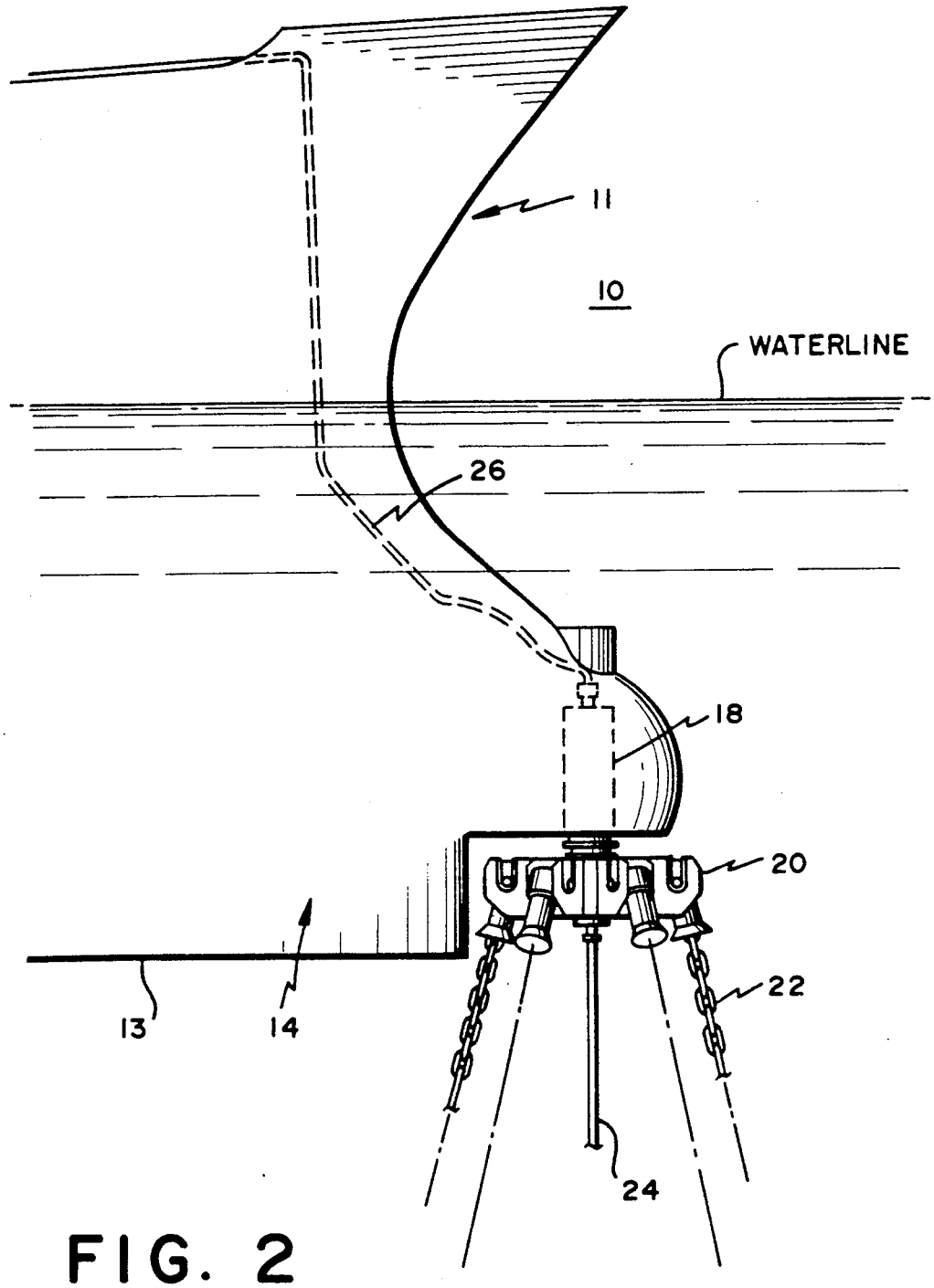
FIG. 2 is a side elevation of a vessel with a vessel turret mooring constructed in accordance with the present invention, with the various elements of the turret mooring shown in phantom.
Figure 3:
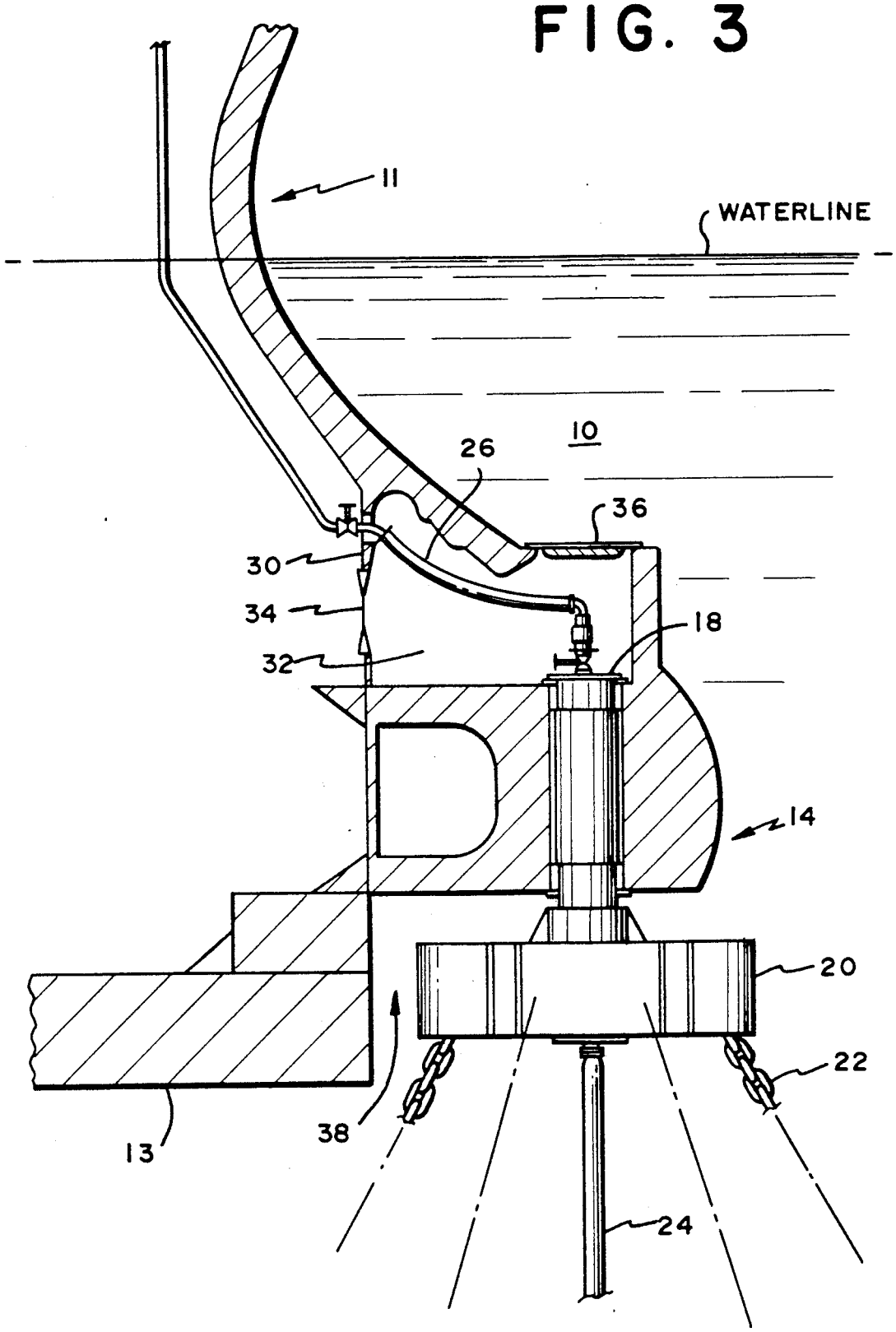
FIG. 3 is a partially sectioned side elevation of a vessel showing the turret mooring of FIG. 2 in greater detail.

The present invention remedies this drawback and a preferred embodiment thereof is illustrated in FIGS. 2 and 3. With specific reference to those figures, it can be seen that the fluid swivel 18, piping 26 and associated mechanisms are all positioned within the bow 14 of the vessel hull 13 below the waterline. An additional bulkhead 30 is built into the front of the bow 14 to form a compartment 32 for reception of the turret mooring assembly 12. The piping 26, fluid swivel joint 18 and associated connections and bearings can be accessed through a watertight door 34 that is formed in the bulkhead 30. An additional access opening 36 is provided to allow access to be gained to the turret mooring assembly 12 externally as illustrated in FIG. 3. A notch 38 is removed from the bow 14 to make room for the spider 20. Thus, the present invention enables the turret mooring 12 to be serviced or monitored from within the vessel hull 13 without taking the vessel 11 or turret mooring 12 out of operation.

Although the invention has been disclosed in terms of a preferred embodiment, it will be understood that numerous modification and variations could be made thereto without departing from the true spirit and scope of the invention as set forth in the following claims. For example, although the vessel 11 illustrated in FIGS. 2 and 3 is shown as having a bulbous bow 14 in which is formed the watertight compartment 32, a similar watertight compartment could be formed in a vessel having any other type of bow construction as well. Further, it is not necessary that the mooring assembly 12 be mounted in the bow of the vessel and it will be understood that it could be mounted in any other portion of the hull of the vessel if desired.

What is claimed is:

1. A mooring arrangement for a seagoing vessel, comprising:

(a) a vessel having a hull, a bow and a watertight compartment in said bow below a waterline of said vessel;

(b) a turret mooring disposed in said hull at said bow, said turret mooring including:

(i) a fluid swivel disposed in said hull at said bow having a top exposed to said watertight compartment and a bottom exposed to an exterior of said hull; and (ii) a spider attached to said bottom of said fluid swivel and disposed external of said hull;

(c) a length of piping attached to said top of said fluid swivel and disposed in said watertight compartment; and, (d) at least a first access door disposed in said compartment for gaining access to the compartment from within said vessel.

2. The mooring arrangement of claim 1 further including at least a second access door disposed in said compartment for gaining access to said compartment from an exterior of said vessel.

* * * * *